US008577524B2

(12) United States Patent
Kado

(10) Patent No.: US 8,577,524 B2
(45) Date of Patent: Nov. 5, 2013

(54) WATERCRAFT PROPULSION DEVICE

(75) Inventor: Takuya Kado, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 13/461,825

(22) Filed: May 2, 2012

(65) Prior Publication Data

US 2013/0096743 A1 Apr. 18, 2013

(30) Foreign Application Priority Data

Oct. 13, 2011 (JP) ..... 2011-226168

(51) Int. Cl.

| | |
|---|---|
| ***F02D 9/02*** | (2006.01) |
| ***F02D 17/02*** | (2006.01) |
| ***F02D 41/14*** | (2006.01) |
| ***F02P 5/15*** | (2006.01) |

(52) U.S. Cl.
USPC ..... 701/21; 440/84; 440/87

(58) Field of Classification Search
USPC ..... 701/21; 440/84, 87
See application file for complete search history.

(56) References Cited

U.S. PATENT DOCUMENTS

| | | | | |
|---|---|---|---|---|
| 5,060,608 | A | 10/1991 | Umemoto | |
| 5,117,792 | A * | 6/1992 | Kanno | 123/335 |
| 6,752,672 | B2 * | 6/2004 | Kanno | 440/84 |
| 7,762,859 | B2 * | 7/2010 | Suzuki et al. | 440/1 |
| 2003/0075150 | A1 * | 4/2003 | Saito | 123/399 |

FOREIGN PATENT DOCUMENTS

JP 03-210068 A 9/1991

OTHER PUBLICATIONS

Kado, "Watercraft Propulsion Device," U.S. Appl. No. 13/872,249, filed Apr. 29, 2013.

* cited by examiner

*Primary Examiner* — Mary Cheung
*Assistant Examiner* — Brian P Sweeney
(74) *Attorney, Agent, or Firm* — Keating & Bennett, LLP

(57) ABSTRACT

A watercraft propulsion device includes an engine, a drive shaft, a propeller shaft, a rotational speed detector, and a controller. The drive shaft transmits power from the engine. The propeller shaft is rotationally driven by power transmitted from the drive shaft. The rotational speed detector detects an engine rotational speed. The controller executes a suppression control to suppress the engine rotational speed when a change rate of the engine rotational speed is equal to or larger than a prescribed value.

12 Claims, 11 Drawing Sheets

| Engine rotational speed N | Number of misfiring cylinders (RN<r) | Number of misfiring cylinders (RN≥r) |
|---|---|---|
| Na1≤N<Na2 | 1 | 1 |
| Na2≤N<Na3(Nb) | 2 | 2 |
| Na3(Nb)≤N<Na4 | 3 | 4 |
| Na4≤N | 4 | 4 |

FIG. 5

| Engine rotational speed N | Number of misfiring cylinders (N=Nregular) | Number of misfiring cylinders (N=Ninstant) |
|---|---|---|
| Na1≤N<Na2 | 1 | 1 |
| Na2≤N<Na3(Nc) | 2 | 2 |
| Na3(Nc)≤N<Na4 | 3 | 4 |
| Na4≤N | 4 | 4 |

FIG. 8

Continuous O/R state

Throttle opening degree

WATERCRAFT PROPULSION DEVICE

BACKGROUND OF THE INVENTION

1. Field of the Invention

The present invention relates to a watercraft propulsion device.

2. Description of the Related Art

There is a known control to suppress a rotational speed of an engine by stopping a spark ignition (hereinafter called "misfiring") when a rotational speed of the engine exceeds a prescribed rotational speed. For example, an ignition control apparatus of an engine disclosed in Laid-open Japanese Patent Application Publication No. 2002-480412 is configured to set a misfiring mode when a throttle is opened rapidly. While the misfiring mode is set, misfiring of the engine is executed when the engine rotational speed becomes equal to or higher than a prescribed rotational speed. Meanwhile, Laid-open Japanese Patent Application Publication No. 03-210068 discloses an engine control apparatus in which a temperature of an engine is detected using a temperature sensor and a rotational speed of the engine is detected using a rotational speed sensor. If engine overheating is detected, then the apparatus executes misfiring of the engine according to a prescribed procedure such that the rotational speed of the engine becomes equal to a prescribed rotational speed.

With the engine ignition control apparatus disclosed in Laid-open Japanese Patent Application Publication No. 2002-480412, an engine can be prevented from being overrevved due to a rapid operation of a throttle by a driver. However, in the case of an outboard boat motor or other watercraft propulsion device, there are times when the engine enters an unloaded state temporarily due to, for example, the propeller becoming exposed above the water surface. In such a case, the engine rotational speed may increase abruptly even though the operator has not performed an abrupt operation of the throttle. Thus, in the case of a watercraft propulsion device, it is difficult for an increase of the engine rotational speed to be suppressed using the control presented in Laid-open Japanese Patent Application Publication No. 2002-480412.

In the engine control apparatus disclosed in Laid-open Japanese Patent Application Publication No. 03-210068, the engine rotational speed is controlled to a prescribed rotational speed by executing engine misfiring according to a prescribed procedure. Consequently, an increase of the engine rotational speed can be suppressed regardless of whether an operator performs an abrupt throttle operation or not. However, if the engine enters an unloaded state as explained above, then the engine rotational speed will increase instantaneously. It is difficult to counter such an instantaneous increase of the engine rotational speed in an instantaneous fashion by merely executing misfiring in accordance with the engine rotational speed in the manner of the engine control apparatus disclosed in Laid-open Japanese Patent Application Publication No. 03-210068.

SUMMARY OF THE INVENTION

Preferred embodiments of the present invention provide a watercraft propulsion device that counters an instantaneous increase of an engine rotational speed in an instantaneous manner.

A watercraft propulsion device according to a preferred embodiment of the present invention includes an engine, a drive shaft, a propeller shaft, a rotational speed detector, and a controller. The drive shaft transmits power from the engine.

The propeller shaft is rotationally driven by power transmitted from the drive shaft. The rotational speed detector detects an engine rotational speed. The controller executes a suppression control to suppress the rotational speed of the engine when a change rate of the engine rotational speed is equal to or larger than a prescribed value.

A watercraft propulsion device according to another preferred embodiment of the present invention includes an engine, a drive shaft, a propeller shaft, and a controller. The drive shaft transmits power from the engine. The propeller shaft is rotationally driven by power transmitted from the drive shaft. The controller executes a suppression control to suppress an engine rotational speed when a first computed rotational speed is equal to or larger than a first threshold value. The first computed rotational speed is an engine rotational speed computed based on rotation time per first rotational angle of the engine. The controller is configured to execute a suppression control when a second computed rotational speed is equal to or larger than a second threshold value. The second computed rotational speed is an engine rotational speed computed based on rotation time per second rotational angle that is smaller than the first rotational angle.

A watercraft propulsion device according to a preferred embodiment of the present invention executes a suppression control to suppress an engine rotational speed when a change rate of the engine rotational speed is equal to or larger than a prescribe value. Thus, a determination to execute or not execute the suppression control is made based on the change rate of the engine rotational speed. As a result, an instantaneous increase of the engine rotational speed can be countered in an instantaneous fashion.

A watercraft propulsion device according to another preferred embodiment of the present invention uses a first computed rotational speed and a second computed rotational speed as engine rotational speeds to determine whether to execute a suppression control. The second computed rotational speed is computed using a rotation time per rotational angle that is smaller than a rotational angle used to compute the first computed rotational speed. As a result, by determining whether to execute the suppression control using the second computed rotational speed, an instantaneous increase of the engine rotational speed can be countered in an instantaneous fashion.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 5 is a table showing numbers of misfiring cylinders corresponding to an engine rotational speed N and an engine rotational speed change rate RN during a suppression control according to the first preferred embodiment of the present invention.

FIG. 8 is a table showing numbers of misfiring cylinders corresponding to a first computed rotational speed Nregular and a second computed rotational speed Ninstant during a suppression control according to the second preferred embodiment of the present invention.

DETAILED DESCRIPTION OF THE PREFERRED EMBODIMENTS

Figure 1:
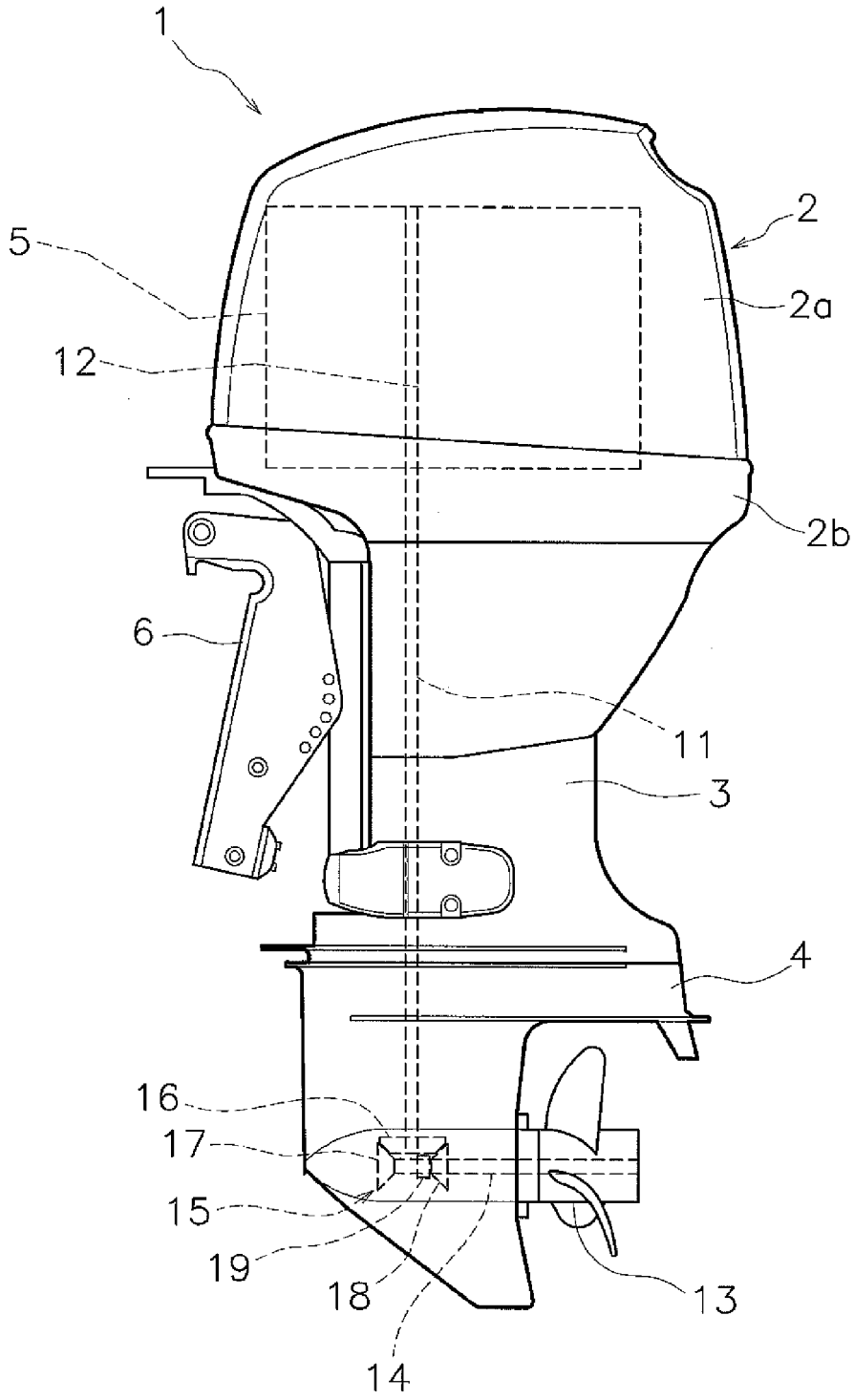
FIG. 1 is a side view of a watercraft propulsion device according to a preferred embodiment of the present invention.

A watercraft propulsion device according to preferred embodiments of the present invention will now be explained with reference to the drawings. FIG. 1 is a side view of a watercraft propulsion device 1 according to a preferred embodiment of the present invention. The watercraft propulsion device 1 preferably is an outboard boat motor. The watercraft propulsion device 1 includes an engine cover 2, an upper casing 3, a lower casing 4, an engine 5, and a bracket 6. The engine cover 2 houses the engine 5. The engine cover 2 includes an upper engine cover 2*a* and a lower engine cover 2*b*. The upper engine cover 2*a* is arranged above the lower engine cover 2*b*. The upper casing 3 is arranged below the lower engine cover 2*b*. The lower casing 4 is arranged below the upper casing 3. The watercraft propulsion device 1 is attached to a hull (not shown) through the bracket 6.

The engine 5 is arranged inside the engine cover 2. The engine 5 preferably is a multiple cylinder engine and the cylinders are arranged vertically adjacent to one another, for example. In this preferred embodiment, the engine 5 preferably includes four cylinders, for example. The engine 5 includes a crankshaft 12. The crankshaft 12 extends along a vertical direction. A drive shaft 11 is arranged inside the upper casing 3 and the lower casing 4. The drive shaft 11 is arranged to extend along a vertical direction inside the upper casing 3 and the lower casing 4. The drive shaft 11 is connected to the crankshaft 12 of the engine 5 and serves to transmit power from the engine 5. A propeller 13 is arranged on a lower portion of the lower casing 4. The propeller 13 is arranged below the engine 5. The propeller 13 is connected to a propeller shaft 14. The propeller shaft 14 is arranged to extend along a front-to-rear direction. The propeller shaft 14 connects to a lower portion of the drive shaft 11 through a shift mechanism 15. The propeller shaft 14 is rotationally driven by power transmitted from the drive shaft 11.

The shift mechanism 15 is configured to change a rotation direction of power transmitted from the drive shaft 11 to the propeller shaft 14. The shift mechanism 15 includes a pinion gear 16, a forward propulsion gear 17, a reverse propulsion gear 18, and a dog clutch 19. The pinion gear 16 is connected to the drive shaft 11. The pinion gear 16 meshes with the forward propulsion gear 17 and the reverse propulsion gear 18. The forward propulsion gear 17 and the reverse propulsion gear 18 are arranged such that they can undergo relative rotation with respect to the propeller shaft 14. The dog clutch 19 is attached non-rotatably to the propeller shaft 14. The dog clutch 19 is arranged such that it can move along an axial direction of the propeller shaft 14 to a forward propulsion position, a reverse propulsion position, and a neutral position. The dog clutch 19 moves between the forward propulsion position, the reverse propulsion position, and the neutral position in response to operation of an operating device 31 (see FIG. 2) that is explained later. In the forward propulsion position, the dog clutch 19 fastens the forward propulsion gear 17 and the propeller shaft 14 together such that they cannot undergo relative rotation. In this state, rotation of the drive shaft 11 is transmitted to the propeller shaft 14 through the forward propulsion gear 17. As a result, the propeller 13 rotates in a direction of propelling the hull forward. In the reverse propulsion position, the dog clutch 19 fastens the reverse propulsion gear 18 and the propeller shaft 14 together such that they cannot undergo relative rotation. In this state, rotation of the drive shaft 11 is transmitted to the propeller shaft 14 through the reverse propulsion gear 18. As a result, the propeller 13 rotates in a direction of propelling the hull rearward. When the dog clutch is in the neutral position located between the forward propulsion position and the reverse propulsion position, the forward propulsion gear 17 and the reverse propulsion gear 18 can rotate relative to the propeller shaft 14. Thus, rotation from the drive shaft 11 is not transmitted to the propeller shaft 14 and the propeller shaft 14 can rotate idly.

Figure 2:
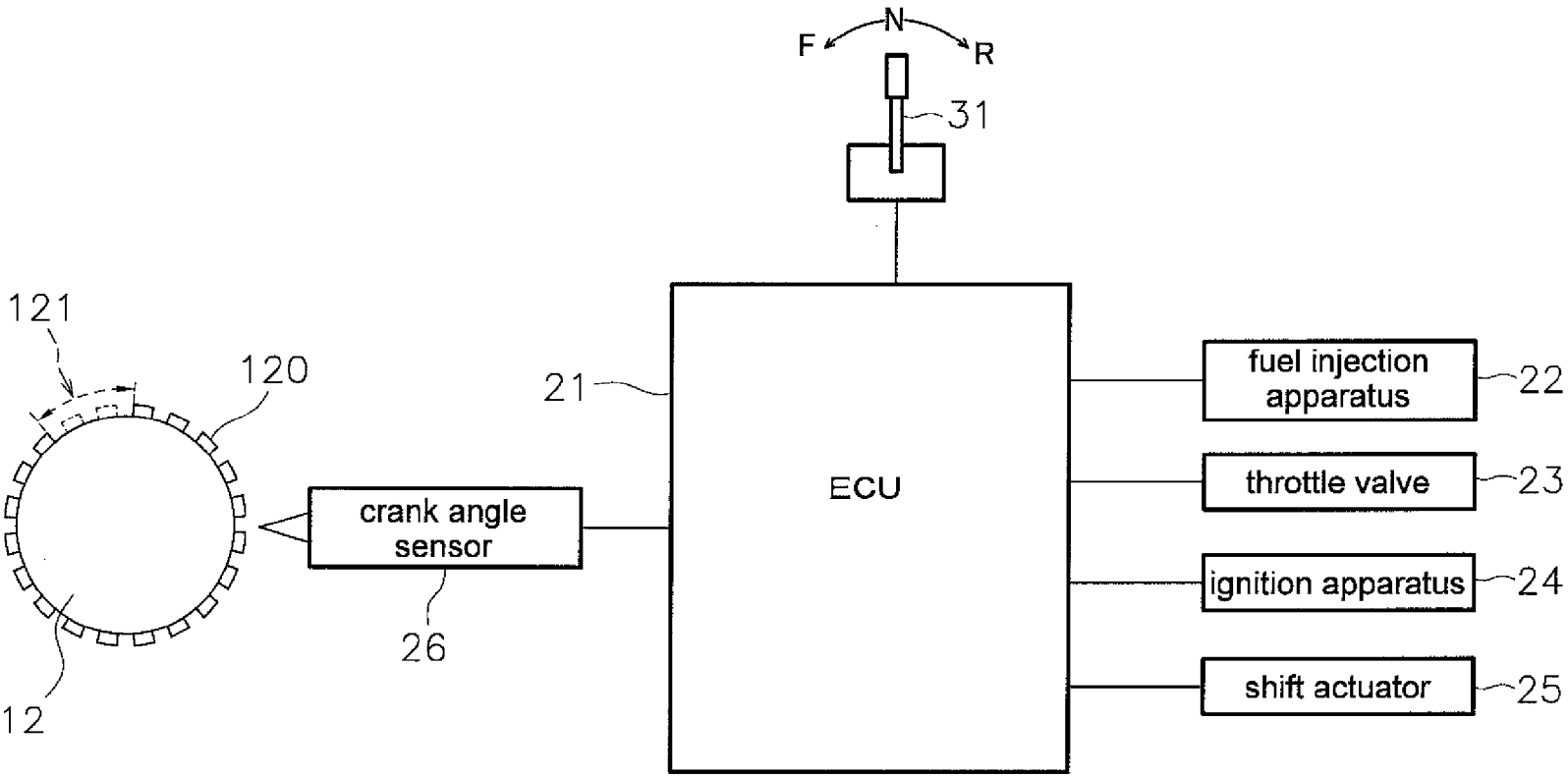
FIG. 2 is a block diagram showing an engine control system and an operating device of the watercraft propulsion device.

FIG. 2 is a block diagram showing a control system for the engine 5 and an operating device 31 of the watercraft propulsion device 1. The engine 5 is controlled by an ECU 21 (engine control unit). The ECU 21 is an example of a controller according to a preferred embodiment of the present invention. The ECU 21 stores a control program that controls the engine 5. The ECU 21 controls operations of a fuel injection apparatus 22, a throttle valve 23, and a spark ignition apparatus 24, and a shift actuator 25 based on information related to the engine 5 detected by various sensors (not shown). The fuel injection device 22 is configured to inject fuel into a combustion chamber of the engine 5. An amount of air-fuel mixture delivered to the combustion chamber is adjusted by varying an opening degree of the throttle valve 23. The ignition apparatus 24 serves to ignite fuel inside the combustion chamber. Although not depicted in FIG. 2, a fuel injection apparatus 22, a throttle valve 23, and an ignition apparatus 24 are provided on each cylinder of the engine 5.

The operating device 31 is attached to the hull. The operating device 31 is, for example, an operating lever. The operating device 31 is configured to send an operating signal to control an output of the engine 5 to the ECU 21 in accordance with an operating state of the operating device 31. The ECU 21 controls the engine 5 based on the operation signal from the operating device 31. When an operator operates the operating device 31, an operation signal indicating a detection value corresponding to a position of the operating device 31 is issued from the operating device 31. This operation signal can be used to control a throttle opening degree and a speed of the watercraft. The operator can also select whether to propel the watercraft forward or in reverse by operating the operating device 31. More specifically, the operating device 31 can be set to any one of a forward propulsion position (F), a reverse propulsion position (R), and a neutral position (N). The ECU 21 controls a shift actuator 25 based on the operation signal from the operating device 31. The shift actuator 25 includes, for example, a motor or other driving device. The shift actuator 25 is controlled by the ECU 21 and moves the dog clutch 19 among the forward propulsion position, the reverse propulsion position, and the neutral position.

As shown in FIG. 2, the watercraft propulsion device 1 includes a crank angle sensor 26. The ECU 21 computes an engine rotational speed based on a detection signal from the crank angle sensor 26. The crank angle sensor 26 is an example of a "rotational speed detector that detects an engine rotational speed" according to a preferred embodiment of the present invention. The crank angle sensor 26 is a magnetic sensor configured to detect the passage of a plurality of protrusions 120 provided on the crankshaft 12 as shown in FIG. 2. In FIG. 2, only a portion of the protrusions 120 are indicated with the reference numeral 120. The protrusions 120 are arranged regularly on a surface of the crankshaft 12. The surface of the crankshaft 12 also includes a blank portion 121. The blank portion 121 is a portion where no protrusions 120 are located and a gap between adjacent protrusions 120 is different than between other protrusions 120.

Figure 3:
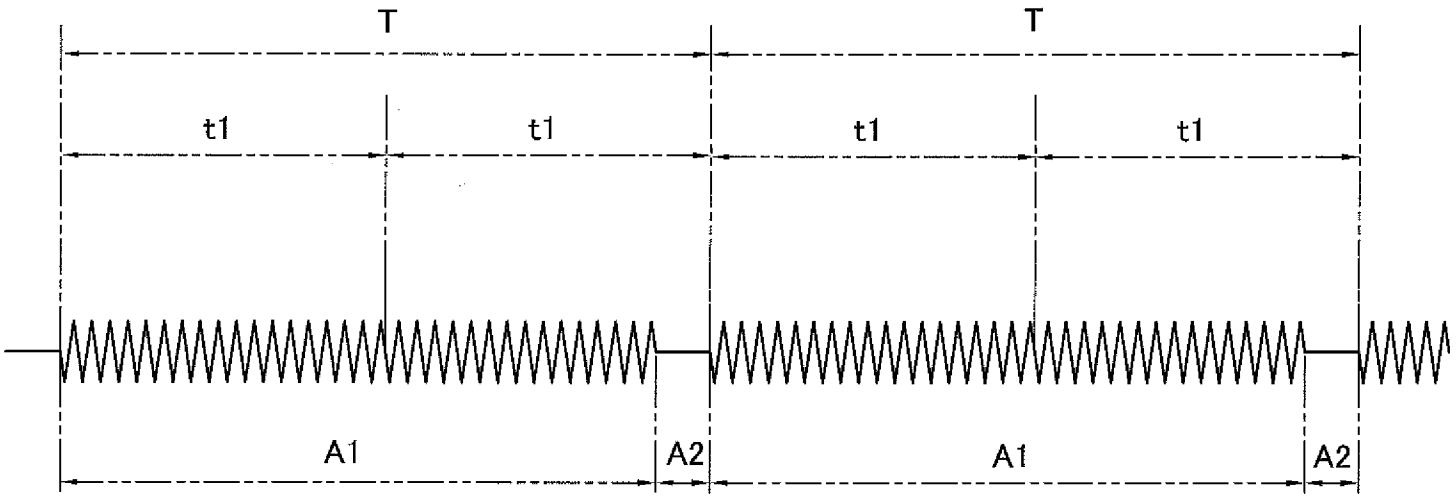
FIG. 3 is a time chart showing a detection signal generated by a crank angle sensor.

FIG. 3 is a time chart showing a detection signal generated by the crank angle sensor 26. As shown in FIG. 3, a magnetic field becomes stronger when one of the protrusions 120 passes through a position facing opposite the crank angle sensor 26 and, thus, the detection signal rises and falls periodically. Meanwhile, when the blank portion 121 passes through the position facing the crank angle sensor 26, a rising waveform is not generated and the same signal strength produced continuously. Consequently, first regions A1 and second regions A2 appear alternately in the detection signal of the crank angle sensor 26. The first regions A1 are regions in which the signal continuously rises and falls in a periodic manner due to the protrusions 120 passing by the crank angle sensor 26. The second regions A2 are regions in which the signal is continuously flat due to the blank portion 121 passing by the crank angle sensor 26. A rotational angle of the crankshaft 12 is detected by detecting the first regions A1 and the second regions A2. Based on a rotation time t1 per prescribed first rotational angle of the crankshaft 12, the ECU 21 computes an engine rotational speed to determine if over-revving of the engine 5 is occurring. For example, in FIG. 3 the rotation time t1 per prescribed first rotational angle is half of one period T of the crankshaft 12, i.e., a rotation time per 180 degrees of rotation. The ECU 21 controls a fuel injecting timing and an ignition timing based on the first rotational angle.

Figure 4:
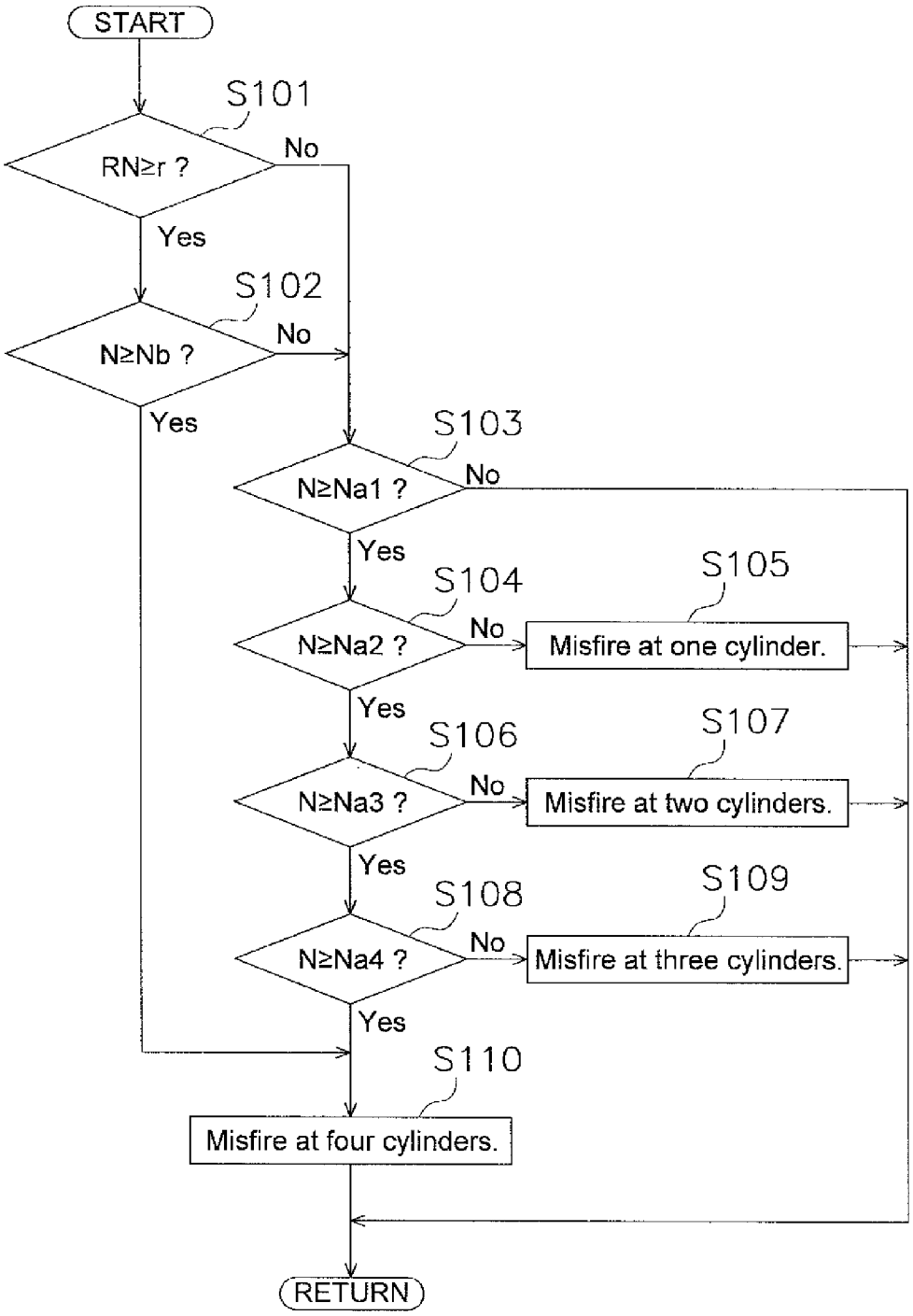
FIG. 4 is a flowchart showing processing steps of a suppression control according to a first preferred embodiment of the present invention.

Based on the engine rotational speed, the ECU 21 executes a suppression control to suppress the engine rotational speed. FIG. 4 is a flowchart showing processing steps of a suppression control according to a first preferred embodiment of the present invention. The suppression control includes a normal over-revving determination processing sequence (steps S103 to S110) configured to determine if over-revving of the engine 5 is occurring using the engine rotational speed and an instantaneous over-revving determination processing sequence (steps S101 to S102) configured to determine if over-revving is occurring using a change rate of the engine rotational speed. The suppression control that will now be explained is executed repetitively while the engine 5 is running.

In step S101, the ECU 21 determines if a change rate RN of the engine rotational speed is equal to or larger than a prescribed value r. The change rage RN of the engine rotational speed is an amount of change of the engine rotational speed per prescribed unit of time and expressed as shown in Equation 1 below.

$$RN=N(n)-N(n-1) \quad \text{Equation 1}$$

The component N(n) is an engine rotational speed computed based on a latest detection value of the rotation time t1 per first rotational angle. The component N(n−1) is an engine rotational speed computed based on a detection value of the rotation time t1 per first rotational angle detected one control cycle prior to the latest control cycle.

If the change rate RN of the engine rotational speed is equal to or larger than the prescribed value r, then the ECU 21 proceeds to step S102. In step S102, the ECU 21 determines if the engine rotational speed N is equal to or larger than a prescribed rotational speed Nb. The ECU 21 proceeds to step S103 if it determines that the change rate RN of the engine rotational speed is not equal to or larger than the prescribed value r in step S101 or if it determines that the engine rotational speed N is not equal to or larger than the rotational speed Nb in step S102.

In step S103, the ECU 21 determines if the engine rotational speed N is equal to or larger than a prescribed rotational speed Na1. If the engine rotational speed N is equal to or larger than the rotational speed Na1, then the ECU 21 proceeds to step S104.

In step S104, the ECU 21 determines if the engine rotational speed N is equal to or larger than a prescribed rotational speed Na2. The rotational speed Na2 is a larger value than the rotational speed Na1. If the engine rotational speed N is not equal to or larger than the rotational speed Na2, then the ECU 21 proceeds to step S105. In step S105, misfiring is executed at one cylinder of the engine 5. In this way, the engine rotational speed is suppressed. The misfiring is accomplished by, for example, executing a fuel injection cut control. The fuel injection cut control is configured to control the fuel injection apparatus 22 such that an injection of fuel is stopped.

If the ECU 21 determines that the engine rotational speed N is equal to or larger than the rotational speed Na2 in step S104, then the ECU 21 proceeds to step S106. In step S106, the ECU 21 determines if the engine rotational speed N is equal to or larger than a prescribed rotational speed Na3. The rotational speed Na3 is a larger value than the rotational speed Na2. If the engine rotational speed N is not equal to or larger than the rotational speed Na3, then the ECU 21 proceeds to step S107. In step S107, misfiring is executed at two cylinders of the engine 5.

If the ECU 21 determines that the engine rotational speed N is equal to or larger than the rotational speed Na3 in step S106, then the ECU 21 proceeds to step S108. In step S108, the ECU 21 determines if the engine rotational speed N is equal to or larger than a prescribed rotational speed Na4. The rotational speed Na4 is a larger value than the rotational speed Na3. If the engine rotational speed N is not equal to or larger than the rotational speed Na4, then the ECU 21 proceeds to step S109. In step S109, misfiring is executed at three cylinders of the engine 5.

If the ECU 21 determines that the engine rotational speed N is equal to or larger than the rotational speed Na4 in step S108, then the ECU 21 proceeds to step S110. In step S110, misfiring is executed at four cylinders of the engine 5. That is, in step S110, misfiring is executed at all cylinders of the engine 5.

The ECU 21 also proceeds to step S110 and executes misfiring at all of the cylinders of the engine 5 when it determines that the change rate RN of the engine rotational speed is equal to or larger than the prescribed value R in step S101 and that the engine rotational speed N is equal to or larger than the rotational speed Nb in step S102. The rotational speed Nb is a smaller value than the rotational speed Na4. In this preferred embodiment, the rotational speed Nb is equal to the rotational speed Na3.

FIG. 5 is a table showing a non-limiting example of numbers of misfiring cylinders corresponding to an engine rotational speed N and an engine rotational speed change rate RN during the suppression control explained above. As shown in FIG. 5, when the engine rotational speed is equal to or larger than the value Na1, the ECU 21 increases or decreases the number of cylinders at which misfiring is executed in accordance with an increase or decrease of the engine rotational speed. Thus, the value Na1 is an example of a first rotational speed mentioned according to a preferred embodiment of the present invention. More specifically, when the engine rotational speed N is equal to or larger than Na1 and smaller than Na2, the ECU 21 executes misfiring at one cylinder regardless of the change rate RN of the engine rotational speed. Similarly, when the engine rotational speed N is equal to or larger than Na2 and smaller than Na3 (Nb), the ECU 21 executes misfiring at two cylinders regardless of the change rate RN of the engine rotational speed. On the other hand, when the engine rotational speed N is equal to or larger than Na3 (Nb), the number of cylinders at which misfiring is executed differs depending on whether the change rate RN of the engine rotational speed is equal to or larger than the prescribed value r. Specifically, the ECU 21 executes suppression control at three cylinders when the engine rotational speed N is equal to or larger than Na3 (Nb) and smaller than Na4 and the change rate RN of the engine rotational speed is smaller than the prescribed value r. Meanwhile, the ECU 21 executes suppression control at four cylinders when the engine rotational speed N is equal to or larger than Na3 (Nb) and the change rate RN of the engine rotational speed is equal to or larger than the prescribed value r. Thus, the value Na3 is an example of a second rotational speed according to a preferred embodiment of the present invention. The ECU 21 also executes suppression control at four cylinders when the engine rotational speed N is equal to or larger than Na4 and the change rate RN of the engine rotational speed is smaller than the prescribed value r.

Thus, in the first preferred embodiment of the present invention, a change rate of an engine rotational speed is used to determine whether to execute a suppression control. Consequently, when a load imposed on an engine 5 decreases abruptly, an instantaneous increase in the engine rotational speed can be countered more rapidly than if the suppression control is executed based solely on the engine rotational speed in the manner of a conventional watercraft propulsion device. For example, as shown in FIG. 5, misfiring is executed at all cylinders when the engine rotational speed N reaches the value Na3 (Nb) while the change rate RN of the engine rotational speed is equal to or larger than the prescribed value r. As a result, the engine rotational speed can be decreased expeditiously. Meanwhile, when the change rate RN of the engine rotational speed is smaller than the prescribed value r, the number of cylinders at which misfiring is executed is increased in accordance with an increase of the engine rotational speed. As a result, over-revving of the engine 5 can be suppressed appropriately even when the engine rotational speed has not increased instantaneously.

Figure 6:
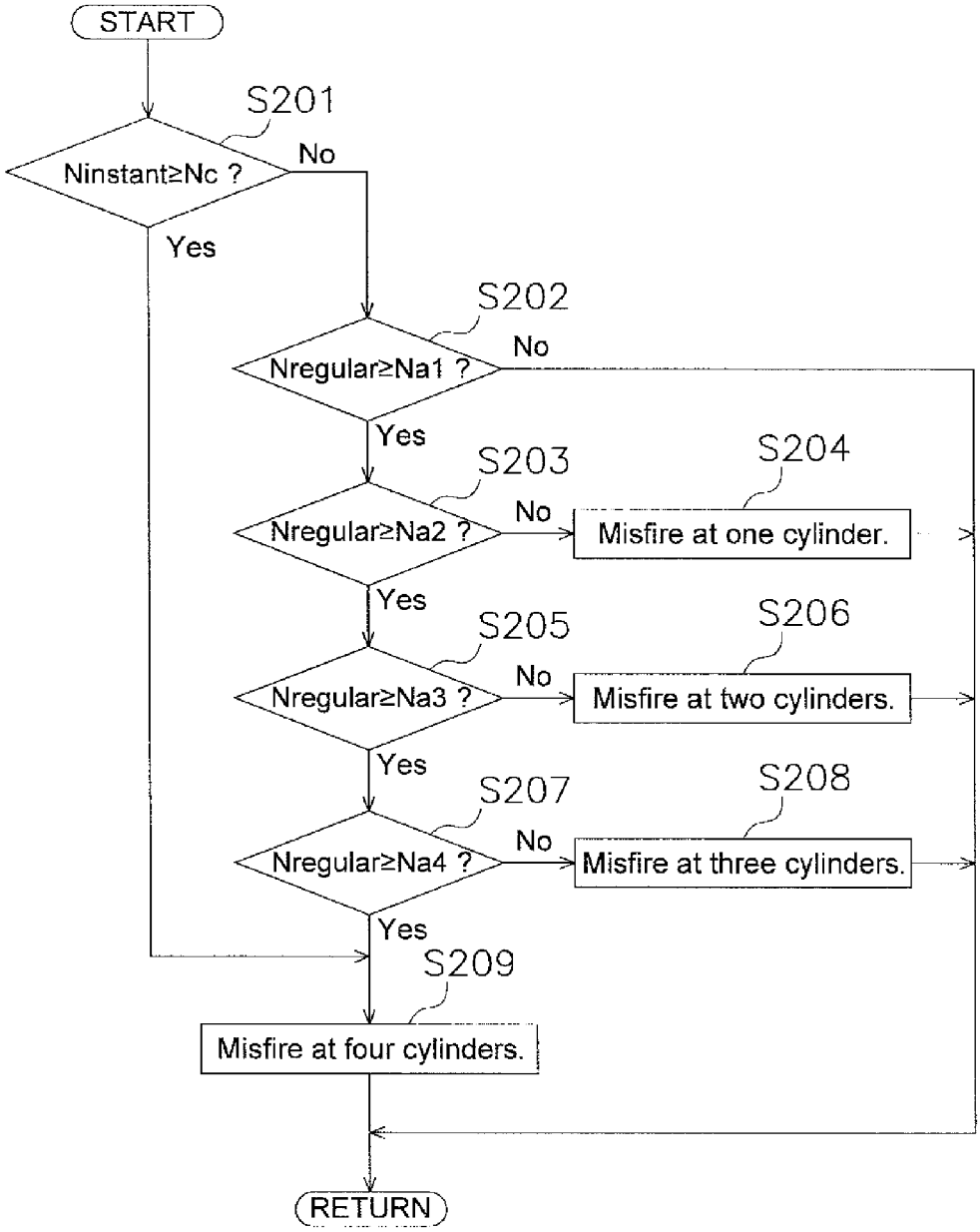
FIG. 6 is a flowchart showing processing steps of a suppression control according to a second preferred embodiment of the present invention.
Figure 7:
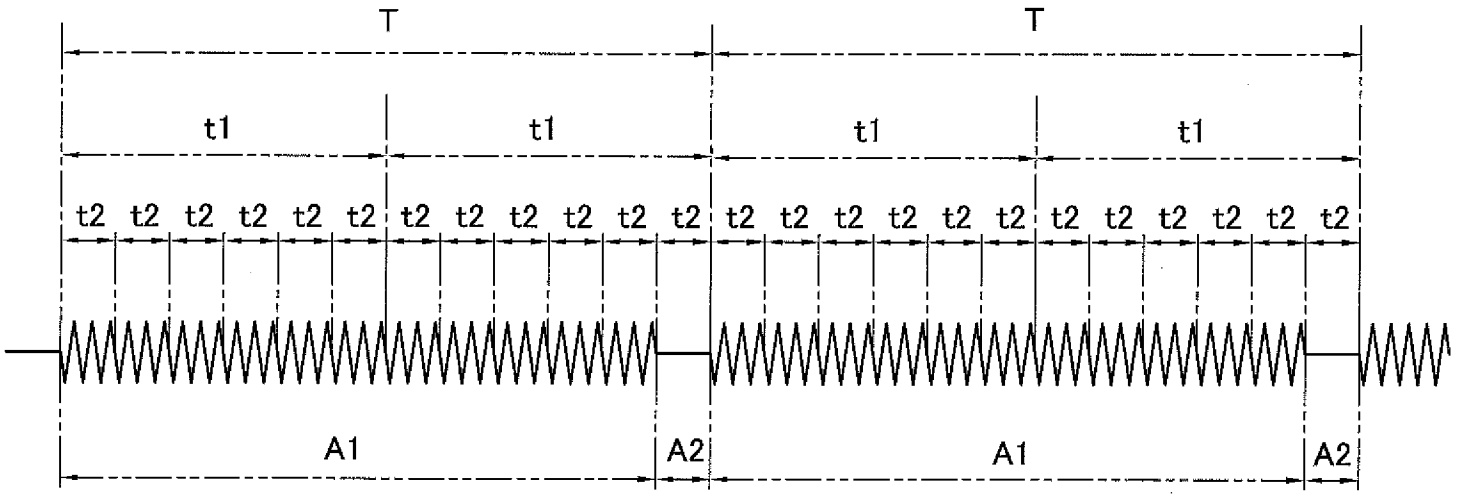
FIG. 7 is a time chart showing a detection signal generated by a crank angle sensor.

A suppression control according to a second preferred embodiment of the present invention will now be explained. FIG. 6 is a flowchart showing processing steps of a suppression control according to a second preferred embodiment of the present invention. The suppression control includes a normal over-revving determination processing sequence (steps S202 to S209) configured to determine if over-revving of the engine 5 is occurring using a first computed rotational speed Nregular and an instantaneous over-revving determination processing step (step S201) configured to determine if over-revving is occurring using a second computed rotational speed Ninstant. The first computed rotational speed Nregular is an engine rotational speed computed based on the rotation time t1 per first rotational angle of the crankshaft 12. Thus, the first computed rotational speed Nregular corresponds to an engine rotational speed used to control a fuel injection and spark ignition. As shown in FIG. 7, the second computed rotational speed Ninstant is an engine rotational speed computed based on a rotation time t2 per second rotational angle that is smaller than the first rotational angle. For example, in FIG. 7 the rotation time t1 per first rotational angle is half of one period T of the crankshaft 12, i.e., a rotation time per 180 degrees of rotation. The rotation time t2 per second rotational angle is ⅙ the rotation time t1 per first rotational angle, i.e., a rotation time per 30 degrees of rotation.

In step S201 of the suppression control flowchart shown in FIG. 6, the ECU 21 determines if the second computed rotational speed Ninstant is equal to or larger than a prescribed rotational speed Nc. If the second computed rotational speed Ninstant is not equal to or larger than the prescribed rotational speed Nc, then the ECU 21 proceeds to step S202. The content of steps S202 to S209 preferably is the same as the content of the steps S103 to S110 of the first preferred embodiment and thus a detailed explanation is omitted here. If the second computed rotational speed Ninstant is equal to or larger than the prescribed rotational speed Nc in step S201, then the ECU 21 proceeds to step S209 and executes misfiring at all cylinders of the engine 5. The rotational speed Nc is a smaller value than the rotational speed Na4. In this preferred embodiment, the rotational speed Nc is equal to the rotational speed Na3. The rotational speed Na4 is an example of a first threshold value according to a preferred embodiment of the present invention. The rotational speed Nc is an example of a second threshold value according to a preferred embodiment of the present invention.

FIG. 8 is a table showing a non-limiting example of numbers of misfiring cylinders corresponding to a first computed rotational speed Nregular and a second computed rotational speed Ninstant during the aforementioned suppression control. As shown in FIG. 8, when the first engine rotational speed Nregular is equal to or larger than the value Na1, the ECU 21 increases or decreases the number of cylinders at which misfiring is executed in accordance with an increase or decrease of the engine rotational speed. More specifically, when the first computed rotational speed Nregular is a value equal to or larger than Na1 and smaller than Na2, misfiring is executed at one cylinder. When the first computed rotational speed Nregular is a value equal to or larger than Na2 and smaller than Na3 (Nc), misfiring is executed at two cylinders. When the first computed rotational speed Nregular is a value equal to or larger than Na3 (Nc) and smaller than Na4, misfiring is executed at three cylinders. When the second computed rotational speed Ninstant is a value equal to or larger than Na3 (Nc) and smaller than Na4, misfiring is executed at four cylinders. Also, when the first computed rotational speed Nregular is a value equal to or larger than Na4, misfiring is executed at all four cylinders.

A watercraft propulsion device according to the second preferred embodiment uses a first computed rotational speed and a second computed rotational speed as engine rotational speeds to determine whether to execute a suppression control. The second computed rotational speed is computed using a rotation time per rotational angle that is smaller than a rotational angle used to compute the first computed rotational speed. Thus, the determination of whether to execute the suppression control is accomplished using both a first computed rotational speed and a second computed rotational speed that is computed at a shorter cycle time than the first computed rotational speed. Consequently, similarly to the first preferred embodiment, an instantaneous increase of the engine rotational speed can be countered in an instantaneous manner when the load imposed on the engine decreases abruptly.

Although preferred embodiments of the present invention have been described above, the present invention is not limited to the preferred embodiments described above. Various changes can be made without departing from the scope of the present invention.

Although in the previously explained preferred embodiments, an outboard boat motor preferably is presented as an example of the watercraft propulsion device, various preferred embodiments of the present invention can be applied to other types of watercraft propulsion devices. For example, it is acceptable to apply various preferred embodiments of the present invention to an inboard/outboard motor. The engine is not limited to four cylinder engine; it is acceptable if the engine includes more than four or fewer than four cylinders. Although in the previously explained preferred embodiments, a crank angle sensor 26 is preferably used as a rotational speed detector, it is acceptable to use another sensor to detect the engine rotational speed. For example, it is acceptable to use a sensor configured to detect a rotational speed of a flywheel magnet. It is also acceptable to use a Hall effect sensor or a magnetic resistance sensor as a sensor to detect a rotational speed.

Although in the previously explained preferred embodiments, a fuel injection cut control is preferably used as the suppression control, it is also acceptable to use another method. For example, it is acceptable to use such methods as executing an ignition cut, reducing a throttle opening degree, changing an ignition timing, and shifting to a leaner air-fuel mixture. It is acceptable to execute one of these methods as the suppression control or to execute a combination of two or more of these methods as the suppression control. An ignition cut control is configured to control the ignition apparatus 24 such that spark ignition of an air-fuel mixture is stopped. A throttle opening reduction control is configured to control the throttle valve 23 such that a throttle opening is reduced. An ignition timing change control is configured to execute a spark ignition of fuel at a timing earlier or later than a normal ignition timing. An air-fuel mixture leaning control is configured to control the throttle valve 23 and/or the fuel injection apparatus 22 such that a proportion of fuel in the air-fuel mixture is reduced. Also, it is acceptable for a cylinder targeted for an ignition cut and/or a fuel injection cut to be a designated cylinder or a cylinder synchronized with a timing at which the suppression control is executed. It is also acceptable for the ignition cut control and/or the fuel injection cut control to be executed only once, continuously, or intermittently, for example.

Although in the first preferred embodiment, the change rate of the engine rotational speed preferably is an amount of change of the engine rotational speed per prescribed unit of time, it is also acceptable for the change rate to be a ratio of engine rotational speeds per prescribed unit of time. For example, it is acceptable for the change rate RN of the engine rotational speed to be expressed using the Equation 2 below.

$$RN=N(n)/N(n-1) \qquad \text{Equation 2}$$

In the first preferred embodiment, a suppression control preferably is executed with respect to at least three cylinders when a change rate RN of the engine rotational speed is smaller than a prescribed value and the engine rotational speed N is larger than a rotational speed Nb. However, it is also acceptable to configure the control such that the suppression control is not executed when the change rate RN of the engine rotational speed is smaller than a prescribed value even if the engine rotational speed N is larger than the rotational speed Nb. For example, if the rotational speed Nb is a value smaller than Na1, then it is possible for the suppression control not to be executed when the change rate RN of the engine rotational speed is smaller than the prescribed value even if the engine rotational speed N is larger than the rotational speed Nb.

Although in the first preferred embodiment, the rotational speed Nb preferably is equal to the value Na3, it is acceptable for the rotational speed Nb to have a value different from Na3. Although in the second preferred embodiment, the rotational speed Nc preferably is equal to the value Na3, it is acceptable for the rotational speed Nc to have a value different from Na3.

In the first preferred embodiment, the engine rotational speed preferably is computed based on a rotation time per rotational angle of 180 degrees. However, the rotational angle used to compute the engine rotational speed is not limited to 180 degrees. In the second preferred embodiment, the first computed rotational speed Nregular preferably is computed based on a rotation time per rotational angle of 180 degrees. However, the rotational angle used to compute the first computed rotational speed Nregular is not limited to 180 degrees. In the second preferred embodiment, the second computed rotational speed Ninstant preferably is computed based on a rotation time per rotational angle of 30 degrees. However, the rotational angle used to compute the second computed rotational speed Ninstant is not limited to 30 degrees.

Figure 9:
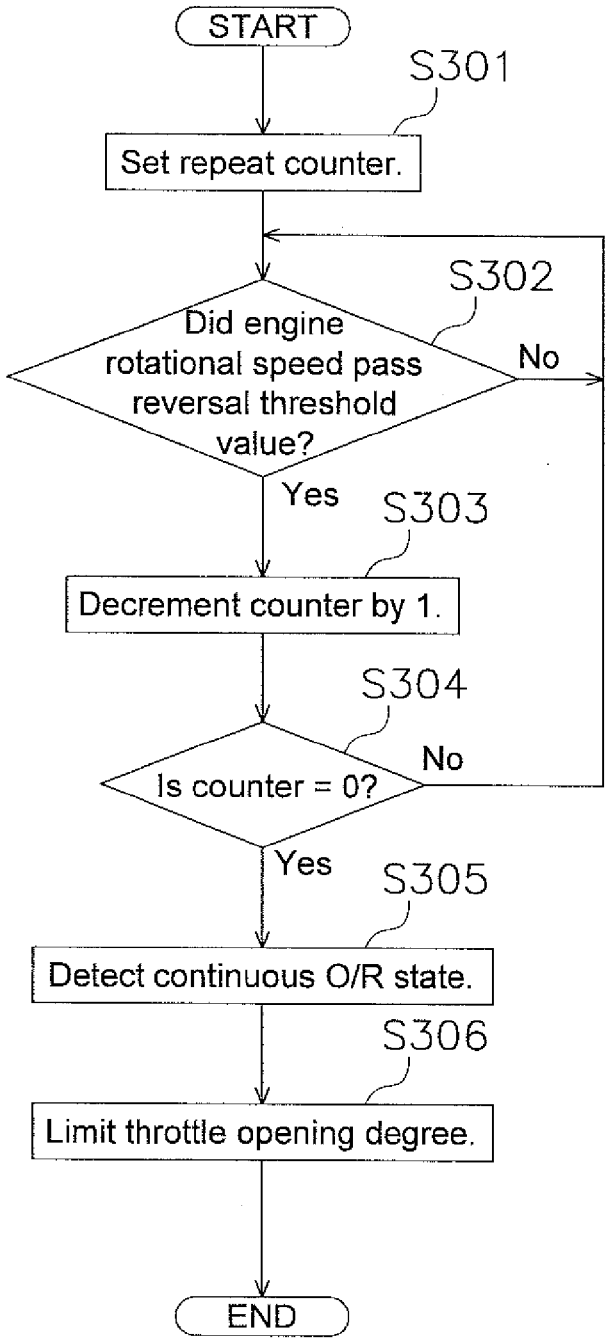
FIG. 9 is a flowchart showing processing steps of a suppression control including a continuous over-revving state determination.

Another suppression control that includes a continuous over-revving state determination and can be executed in conjunction with the suppression control of the first preferred embodiment or the second preferred embodiment will now be explained. FIG. 9 is a flowchart showing processing steps of a suppression control including a continuous over-revving state determination.

In step S301, the ECU 21 sets a repeat counter to a prescribed value. In step S302, the ECU 21 determines if the engine rotational speed has exceeded a prescribed reversal threshold value. The reversal threshold value is set to a rotational speed larger than a maximum rotational speed normally used by a user. The reversal threshold value can be set to, for example, a value equal to the value Na1 but it is acceptable for the reversal threshold value to be a value other than Na1. The reversal threshold value is preferably larger than a maximum rotational speed normally used by a user and smaller than the aforementioned value Na1. A maximum rotational speed normally used by a user is a maximum rotational speed in a case in which the watercraft is equipped with an appropriate size of an outboard boat motor and a propeller. Also, the expression "the engine rotational speed passed the reversal threshold value" refers to both a situation in which the engine rotational speed has risen from a value smaller than the reversal threshold value to a value larger than the reversal threshold value and a situation in which the engine rotational speed has decreased from a value larger than the reversal threshold value to a value smaller than the reversal threshold value. However, it is also acceptable if the expression "the engine rotational speed passed a prescribed reversal threshold value" refers to either a situation in which the engine rotational speed has risen from a value smaller than the reversal threshold value to a value larger than the reversal threshold value or a situation in which the engine rotational speed has decreased from a value larger than the reversal threshold value to a value smaller than the reversal threshold value.

If it is determined in step S302 that the engine rotational speed has passed a prescribed reversal threshold value, then the ECU 21 proceeds to step S303. In step S303, the ECU 21 subtracts 1 from the value of the counter. In step S304, the ECU 21 determines if the value of the counter is zero. If the value of the counter is not zero, then the ECU 21 returns to step S302. If the value of the counter has reached zero, then the ECU 21 proceeds to step S305 and detects that a continuous over-revving state exists. Then, in step S306, the ECU 21 executes a limitation of the throttle opening degree. More specifically, the ECU 21 gradually reduces the throttle opening degree.

It is acceptable for the ECU 21 to execute step S301 after it has executed step S306. In other words, it is acceptable to use execution of the limitation of the throttle opening as a condition for resetting the counter. It is also acceptable to reset the counter when the engine 5 is started.

Even when a suppression control according to the first preferred embodiment or the second preferred embodiment is used, a suppression control including a continuous over-revving state determination similar to that just described is effective in situations where over-revving occurs continuously. For example, there are situations in which the propeller 13 is raised above the water surface due to the watercraft propulsion device 1 being tilted with respect to a hull of the watercraft. There are also situations in which the propeller 13 attached to the watercraft propulsion device 1 is not an appropriate for the size of the hull. In such situations, with only a suppression control according to the first preferred embodiment and the second preferred embodiment, the engine rotational speed will decrease temporarily but it will increase again when the suppression control is ended. The engine rotational speed will decrease temporarily when the suppression control is executed again, afterwards, and the engine rotational speed will increase again. Thus, the engine 5 will enter a state of continuous over-revving.

Figures 10A, 10B, 10C:
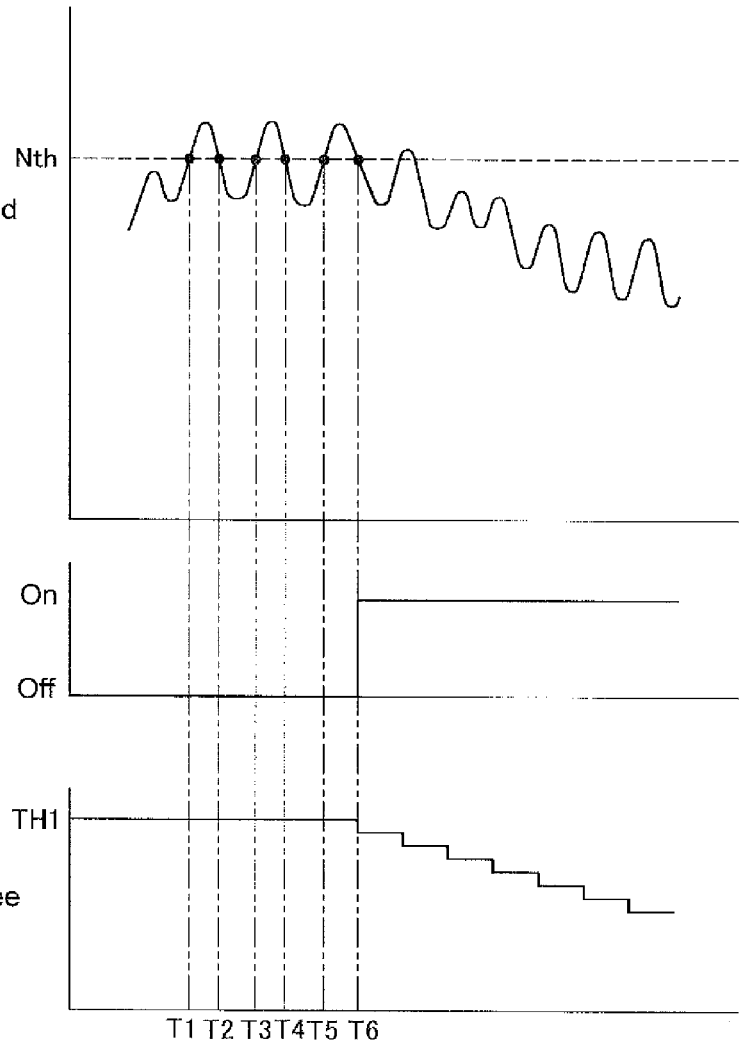
FIGS. 10A-10C are timing charts showing changes of an engine rotational speed, a continuous over-revving state determination flag, and a throttle opening degree when a suppression control including a continuous over-revving state determination is executed.

FIGS. 10A-10C are timing charts showing changes of an engine rotational speed (FIG. 10A), a continuous over-revving state determination flag (FIG. 10B), and a throttle opening degree (FIG. 10C) when a suppression control including the continuous over-revving state determination explained previously is executed. As shown in FIG. 10A, after the engine rotational speed passes a prescribed rotational speed Nth at a time T1, the engine rotational speed repeatedly increases and decreases. More specifically, the engine rotational speed passes the prescribed rotational speed Nth at the times T1, T2, T3, T4, T5, and T6. If the counter of step S301 is set to 6, then at the time T6 the ECU 21 will determine that the number of times the engine rotational speed has repeatedly changed such that it passed through the prescribed rotational speed Nth has reached a prescribed number of times and the continuous over-revving state determination flag will be turned on as shown in FIG. 10B. Thus, in step S305, a continuous over-revving state is detected. As a result, as shown in FIG. 10C, the throttle opening degree is limited after the time T6. Although in this preferred embodiment the number of repeated passes used to execute the suppression control preferably is set to 6, for example, it is acceptable to set the number of repeated passes to a value larger than 6 or a value smaller than 6.

Figure 11:
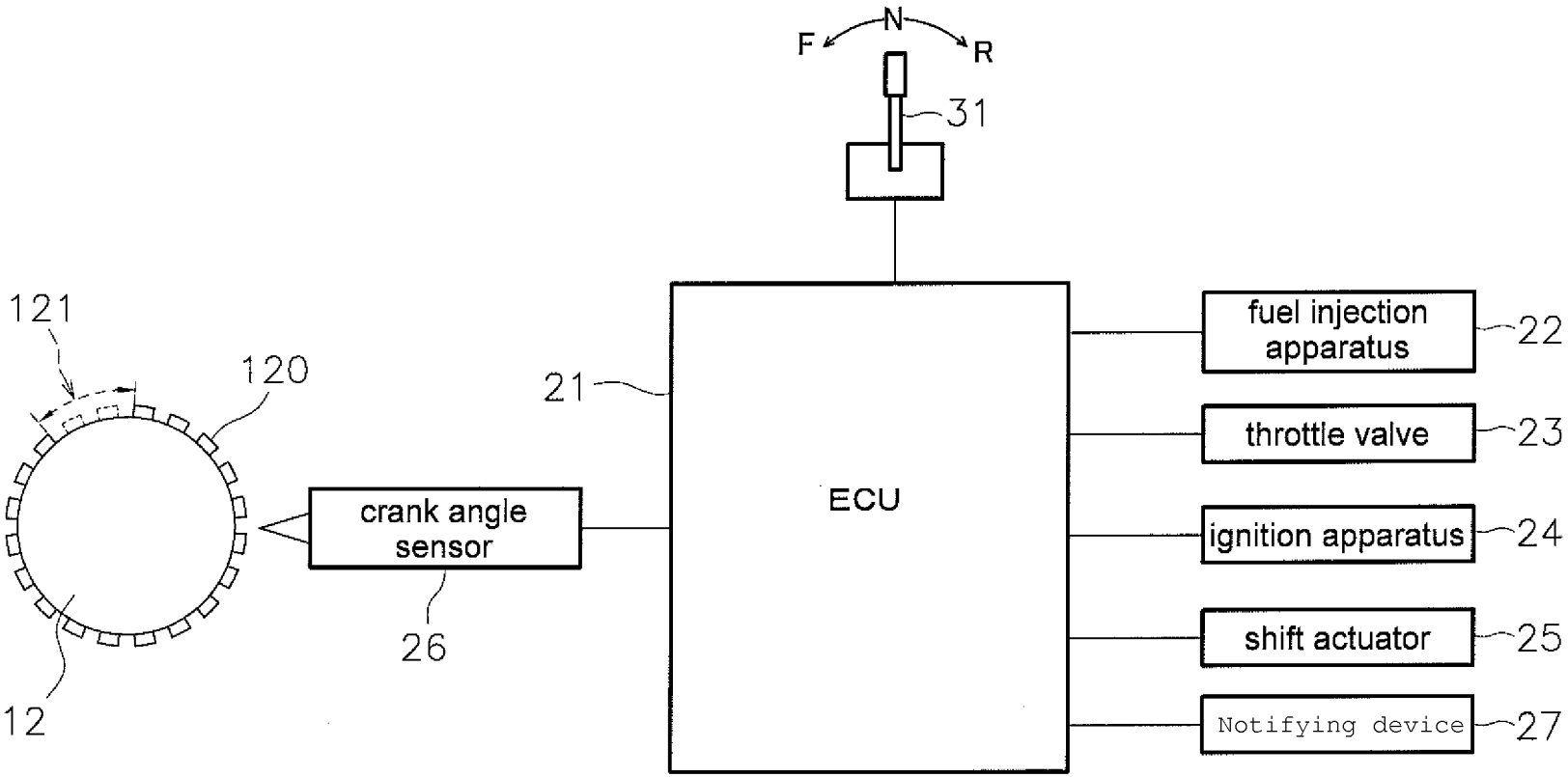
FIG. 11 is a block diagram showing constituent features of a watercraft propulsion device according to another preferred embodiment of the present invention.

As explained previously, by executing a suppression control that includes a continuous over-revving determination, the control can prevent over-revving from occurring repetitively. It is also acceptable to configure the control such that if a continuous over-revving state is detected in step S305, then in step S306 the ECU 21 will issue a warning to an operator instead of limiting the throttle opening degree. In such a case, the watercraft propulsion device 1 is further equipped with a notifying device 27 as shown in FIG. 11. It is acceptable for the notifying device 27 to be a buzzer, a speaker, or other device configured to issue an audible warning, for example. It is also acceptable for the notifying device 27 to be a monitor, a lamp, or other device configured to issue a visible warning, for example. It is also acceptable for a warning issued by the notifying device 27 to be accompanied by a limitation of the throttle opening degree, for example.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft propulsion device comprising:

an engine;

a drive shaft that transmits power from the engine;

a propeller shaft rotationally driven by power transmitted from the drive shaft;

a rotational speed detector that detects an engine rotational speed; and a controller programmed to execute a suppression control to suppress the engine rotational speed when a change rate of the engine rotational speed is equal to or larger than a prescribed value.

2. The watercraft propulsion device according to claim 1, wherein the controller executes the suppression control when the engine rotational speed is equal to or larger than a prescribed rotational speed and the change rate of the engine rotational speed is equal to or larger than the prescribed value.

3. The watercraft propulsion device according to claim 2, wherein the controller does not execute the suppression control when the change rate of the engine rotational speed is smaller than the prescribed value even if the engine rotational speed is equal to or larger than the prescribed rotational speed.

4. The watercraft propulsion device according to claim 1, wherein the change rate of the engine rotational speed is an amount of change of the engine rotational speed per prescribed unit of time.

5. The watercraft propulsion device according to claim 1, wherein the change rate of the engine rotational speed is a ratio of engine rotational speeds per prescribed unit of time.

6. The watercraft propulsion device according to claim 1, wherein the engine includes an ignition apparatus and the controller executes the suppression control by controlling the ignition apparatus.

7. The watercraft propulsion device according to claim 1, wherein the engine includes a fuel injection apparatus and the controller executes the suppression control by controlling the fuel injection apparatus.

8. The watercraft propulsion device according to claim 1, wherein the engine includes a plurality of cylinders;

when the engine rotational speed is equal to or larger than a prescribed first rotational speed, the controller increases a number of the cylinders at which the suppression control is executed in accordance with an increase of the engine rotational speed;

when the engine rotational speed is equal to or larger than the prescribed first rotational speed, the controller decreases the number of the cylinders at which the suppression control is executed in accordance with a decrease of the engine rotational speed; and when the engine rotational speed is equal to or larger than a prescribed second rotational speed and the change rate of the engine rotational speed is equal to or larger than the prescribed value, the controller executes the suppression control at all of the cylinders.

9. The watercraft propulsion device according to claim 1, wherein the engine includes a plurality of cylinders;

the controller increases a number of cylinders at which the suppression control is executed in accordance with an increase of the engine rotational speed when the engine rotational speed is equal to or larger than a prescribed first rotational speed and executes the suppression control at a number n of the cylinders when the engine rotational speed is equal to or larger than a prescribed second rotational speed that is larger than the first rotational speed;

the controller decreases the number of cylinders at which the suppression control is executed in accordance with a decrease of the engine rotational speed when the engine rotational speed is equal to or larger than the prescribed first rotational speed and executes the suppression control at the number n of the cylinders when the engine rotational speed is equal to or larger than the prescribed second rotational speed that is larger than the first rotational speed; and the controller executes the suppression control at a number m, where m>n, of the cylinders when the engine rotational speed is equal to or larger than the second rotational speed and the change rate of the engine rotational speed is equal to or larger than the prescribed value.

10. The watercraft propulsion device according to claim 1, wherein the engine includes a fuel injection apparatus;

the controller executes the suppression control when the engine rotational speed is equal to or larger than a prescribed rotational speed; and the controller decreases a throttle opening degree when a number of times the engine rotational speed has repeatedly changed so as to pass the prescribed rotational speed is equal to or larger than a prescribed number of times.

11. The watercraft propulsion device according to claim 1, further comprising a notifying device; wherein the engine includes a fuel injection apparatus;

the controller executes the suppression control when the engine rotational speed is equal to or larger than a prescribed rotational speed; and the notifying device issues a warning to an operator when a number of times the engine rotational speed has repeatedly exceeded the prescribed rotational speed is equal to or larger than a prescribed number of times.

12. A watercraft propulsion device comprising:

an engine;

a drive shaft that transmits power from the engine;

a propeller shaft rotationally driven by power transmitted from the drive shaft;

a rotational speed detector that detects an engine rotational speed;

a controller programmed to execute a suppression control to suppress the engine rotational speed when the engine rotational speed is equal to or larger than a prescribed rotational speed; and a notifying device; wherein the notifying device issues a warning to an operator when a number of times the engine rotational speed has repeatedly exceeded the prescribed rotational speed is equal to or larger than a prescribed number of times.

* * * * *